US007234423B2

(12) United States Patent
Lindsay

(10) Patent No.: US 7,234,423 B2
(45) Date of Patent: Jun. 26, 2007

(54) INTERNAL COMBUSTION ENGINE

(76) Inventor: Maurice E. Lindsay, 4759 N. Fenimore Ave., Covina, CA (US) 91722

( * ) Notice: Subject to any disclaimer, the term of this patent is extended or adjusted under 35 U.S.C. 154(b) by 12 days.

(21) Appl. No.: 11/161,468

(22) Filed: Aug. 4, 2005

(65) Prior Publication Data

US 2007/0028866 A1 Feb. 8, 2007

(51) Int. Cl.
*F02B 25/08* (2006.01)

(52) U.S. Cl. ..... 123/42; 123/51 BA; 123/188.5

(58) Field of Classification Search ..... 123/42, 123/51 BA, 51 B, 193.6, 276
See application file for complete search history.

(56) References Cited

U.S. PATENT DOCUMENTS 2,397,752 A * 4/1946 Rustad ..... 123/42
3,084,678 A * 4/1963 Lindsay ..... 123/51 BA
6,152,101 A * 11/2000 Parsi ..... 123/276
6,158,409 A * 12/2000 Gillespie et al. ..... 123/193.6

* cited by examiner

*Primary Examiner*—Stephen K. Cronin
*Assistant Examiner*—Hyder Ali
(74) *Attorney, Agent, or Firm*—Kelly Lowry & Kelley, LLP

(57) ABSTRACT

In accordance with the invention, an internal combustion engine having reciprocating piston sleeves is realized comprising an engine block with a pair of cylinders, each cylinder having an intake port, an exhaust port and two linearly opposing pistons connected to two opposing crankshafts. A pair of piston sleeves are reciprocatingly mounted in each cylinder, one piston sleeve around each piston. Each piston sleeve is connected to one of two eccentric shafts that run parallel and adjacent to each crankshaft. The piston sleeves have ported slots in communication with either the intake ports or the exhaust ports of each cylinder. The eccentric shafts are mechanically connected to the crankshafts such that they move in unison.

21 Claims, 9 Drawing Sheets

INTERNAL COMBUSTION ENGINE

BACKGROUND OF THE INVENTION

This invention relates to internal combustion engines and is particularly concerned with two-cycle engines of the opposed piston type wherein a pair of pistons operate oppositely in cylinders that are in communication with each other and reciprocating ported sleeves surround each piston. It is a general object of this invention to provide an internal combustion engine of higher horsepower rating per pound of engine weight and particularly a two-cycle engine that is capable of being supercharged.

U.S. Pat. No. 3,084,678 ("the '678 patent") discloses an internal combustion engine of the type described above having opposed pistons and reciprocating sleeves to alter the porting characteristics of the engine. The disclosure of the '678 patent is incorporated herein in its entirety by this reference.

The engine of the '678 patent comprises opposed pistons having reciprocating sleeves around each piston, wherein related pistons and sleeves are connected to the same crankshaft. This resulted in a configuration that does not permit for adjustment of the timing of the sleeves with respect to the pistons to maximize efficiency and power. Thus, once an engine is constructed pursuant to the '678 patent, the timing of the movement of the reciprocating sleeves is fixed with respect to the movement of the related pistons.

Accordingly, it is an object of present invention to provide an engine having reciprocating sleeves wherein the reciprocating sleeves are connected to a shaft separate and distinct from the crankshaft that moves the related pistons. It is another object of this invention to provide a means to advance or retard the timing of the motion of the reciprocating sleeve shaft with respect to the motion of the piston crankshaft.

It is a further object of this invention to provide a piston connecting rod that is streamlined to generate less resistance and windage during operation of the engine.

It is still another object of this invention to provide for an engine that is entirely of flat plate and tube construction using only tools found in a machine shop, i.e., a lathe, a mill, a drill press, and a power saw.

The present invention fulfills these objects and provides other related advantages.

SUMMARY OF THE INVENTION

In accordance with the invention, an internal combustion engine having reciprocating piston sleeves is realized comprising an engine block with a pair of cylinders, each cylinder having an intake port, an exhaust port and two linearly opposing pistons connected to two opposing crankshafts. A pair of piston sleeves are reciprocatingly mounted in each cylinder, one piston sleeve around each piston. Each piston sleeve is connected to one of two eccentric shafts that run parallel and adjacent to each crankshaft. The piston sleeves have ported slots in communication with either the intake ports or the exhaust ports of each cylinder. The eccentric shafts are mechanically connected to the crankshafts such that they move in unison.

In the preferred embodiment, the piston sleeves are connected to the eccentric shafts by two sleeve connecting rods. The sleeve connecting rods are fixed to the piston sleeves by a lateral barring shaft. The piston sleeves also include a re-enforcing band to reduce twisting and torsion forces.

In one embodiment the eccentric shafts are connected to the crankshafts by means of gears in a 1:1 ratio. In the preferred embodiment, the eccentric shafts are connected to the crankshafts by a sprocket and chain assembly in a 1:1 ratio. The sprocket and chain assembly may include a computer controlled timing guide on the chain to advance or retard the movement of the eccentric shaft with respect to the crankshaft. The computer controlled timing guide comprises a slide and an actuator cylinder connected to the slide. The actuator cylinder may directly connected to the slide or connected to a slide by means of a lever.

The pistons are connected to the crankshaft by means of a piston connecting rod. In the preferred embodiment, the piston connecting rod has a streamlined profile, i.e., either a pointed oval or a flattened diamond cross-section. The top of each piston head may have a curved concave shape or a stepped concave shape depending upon the fuel to be combusted.

The back of the engine includes a drive gear case having a drive gear connected to one or more idler gears which are in turn connected to crankshaft gears. In addition, the front of the engine may have one or more accessory gears connected to the crankshaft gears. The idler gears and accessory gears may be hunting tooth gears. The drive gear, idler gears, crankshaft gears and accessory gears may be spray lubricated.

DETAILED DESCRIPTION OF THE PREFERRED EMBODIMENT

Figure 1:
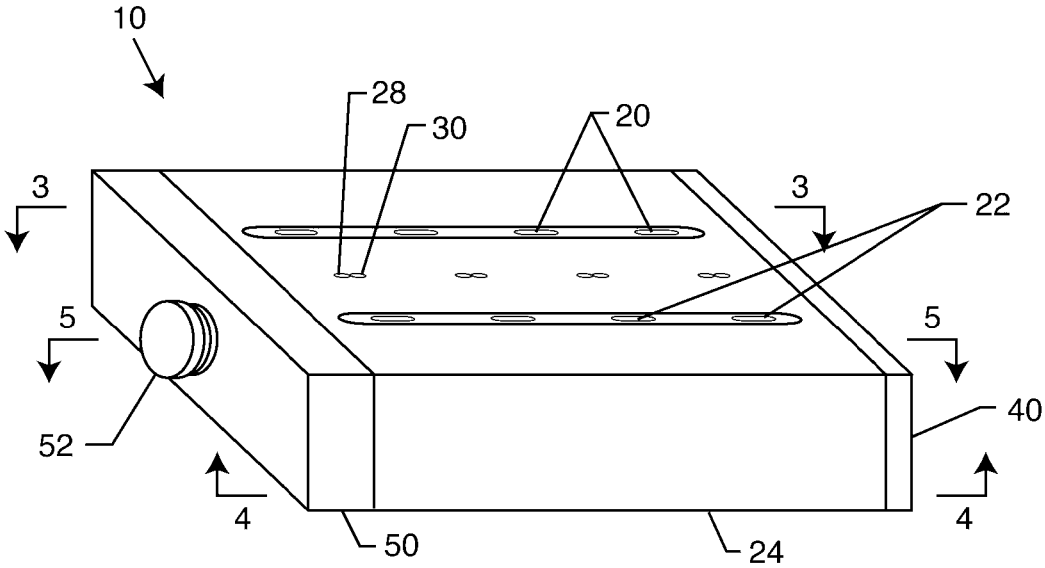
FIG. 1 is an elevated perspective view of the engine of the present invention.

The present invention is directed toward an internal combustion engine 10. More specifically, it is directed toward an internal combustion two-cycle engine 10 having opposed pistons 12 and reciprocating piston sleeves 14 surrounding each of the pistons 12; the pistons 12 and piston sleeves 14 each actuated by separate shaft 16, 18. While the following describes a two-cycle, opposed piston engine 10 having four cylinders 26, the principals of this invention are applicable to two- or four-cycle engines having any number of cylinders.

Figure 2:
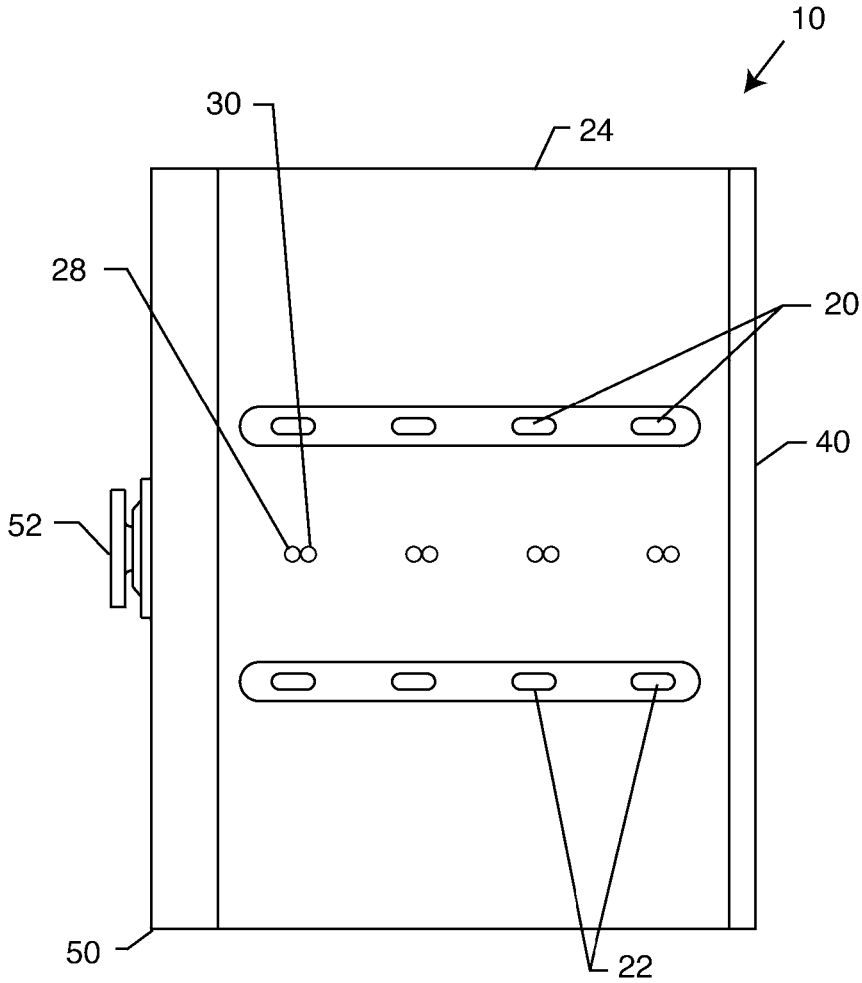
FIG. 2 is a top view of the engine of the present invention. The bottom view is a mirror image of the top view.

As shown in FIGS. 1 and 2, the engine 10 of the present invention has an engine block 24 of a box shape constructed exclusively from flat plate materials. In a four cylinder 26 engine 10, there are four intake ports 26 and four exhaust ports 22 in series on the top side of the block 24. In the center of the engine block 24, between the series of intake 20 and exhaust ports 22 are access points at each cylinder 26 for a fuel injector 28 and spark plug 30. The underside (not shown) of the engine block 24 is a mirror image of the top side.

Each pair of intake 20 and exhaust ports 22 is in communication with one of the cylinders 26. The spark plug 30 and fuel injections 28 may be configured at an angle such that the injected fuel intersects the ignition spark just inside the cylinder 26 for both the top and bottom of the engine block 24. In the preferred embodiment, the spark plug 30 and fuel injector 28 may be parallel and oppositely configured with the fuel injector 28 and spark plug 30 on the other side of the engine block 24. In this configuration, the fuel injected from the top of the engine block 24 would intersect with the spark from the spark plug 30 on the bottom of the engine block 24. Similarly, the fuel injected from the bottom of the engine block 24 would intersect with the spark from the spark plug 30 on the top of the engine block 24. This configuration results in better performance of the engine 10 because the combustion is more evenly distributed throughout the cylinder 26.

Figure 3:
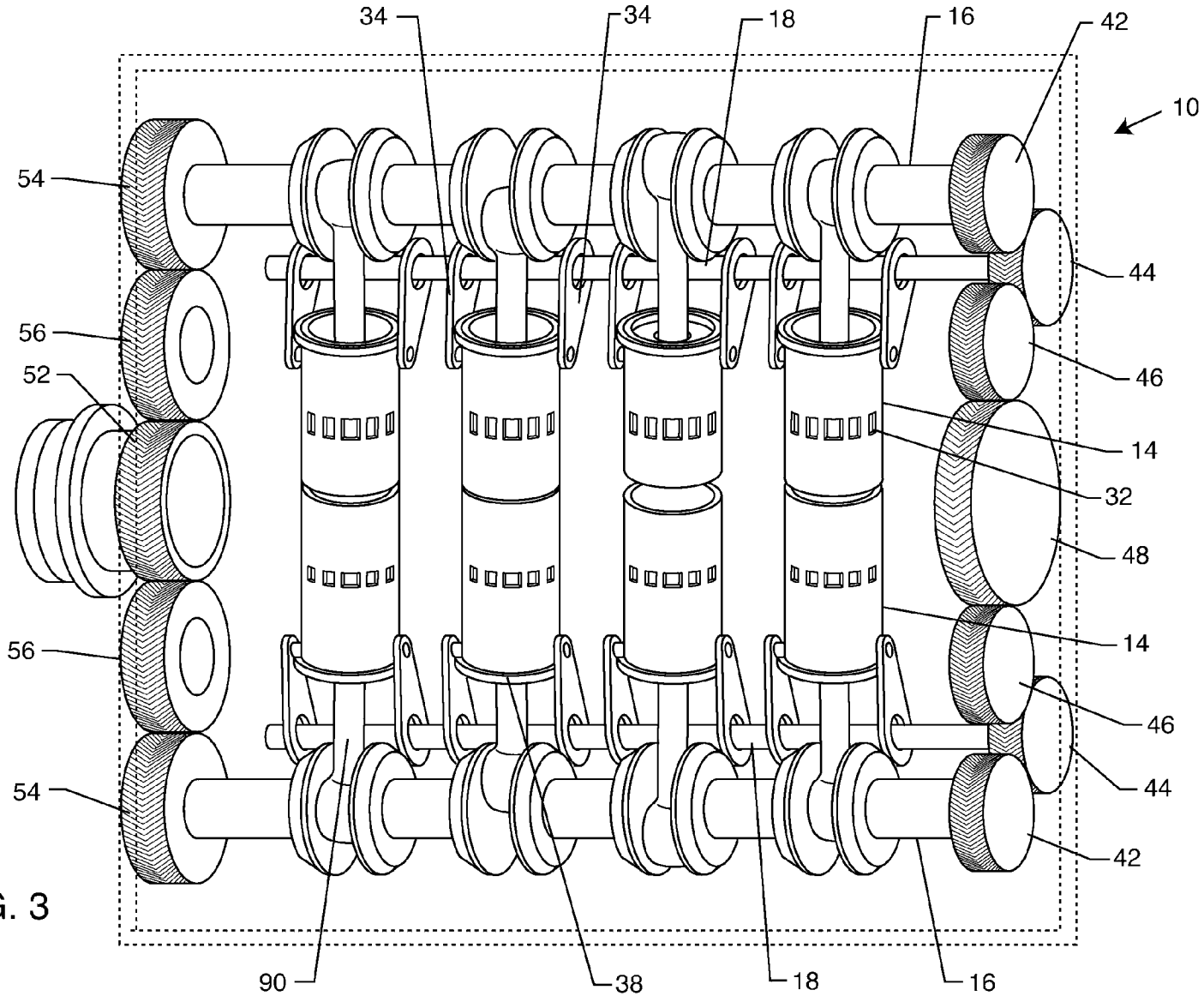
FIG. 3 is a sectional view of the engine of the present invention taking along line 3-3 of FIG. 1.
Figure 4:
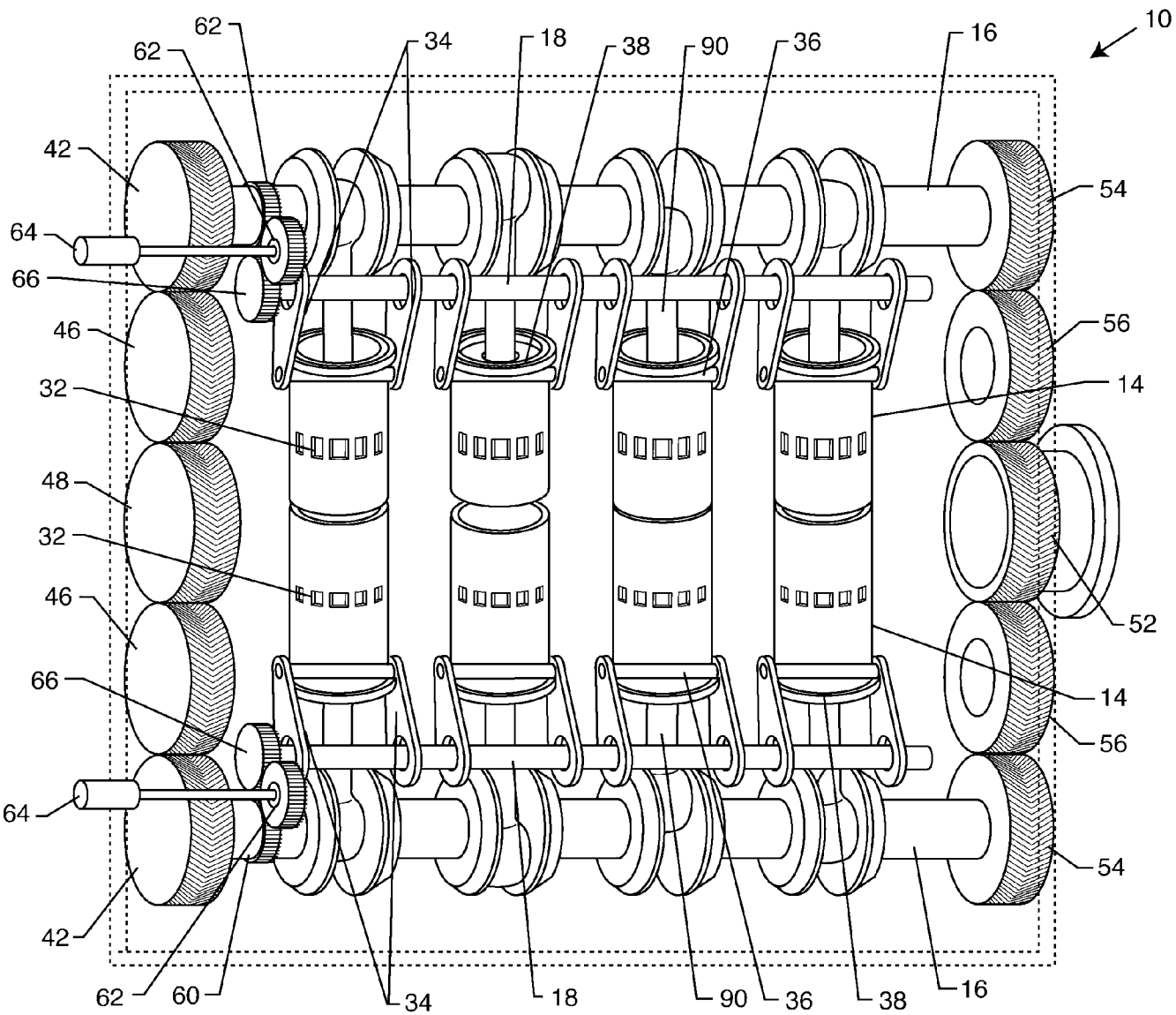
FIG. 4 is a sectional view of the engine of the present invention taking along line 4-4 of FIG. 1.

As shown in FIGS. 3-5 and 7, the front of the engine block 24 has a case for accessory gears 40 and the back of the engine block has a case for power gears 50. The power gear case 50 has an output gear 52 to drive the transmission or other system in which the engine 10 is mounted. As shown in FIGS. 3 and 4, the power gear case 50 consists of a gear on the end of each crankshaft 54, idler gears 56, and a final drive or output gear 52. The crankshaft gears 54 and final drive gear 52 each have the same number of teeth.

The idler gears 56 may have one more or one less tooth than the adjacent crankshaft 54 or final drive gears 52. This is referred to as a hunting tooth gear. The purpose of this configuration is so that every tooth in the hunting tooth or idler gears 56 contacts every tooth in the crankshaft 54 and final drive gears 52. This assures even wear on all teeth on all gears and results in a much longer gear life. In addition, all of these gears have extra wide teeth, which decreases stress and also reduces friction. In the preferred embodiment, the gears in the power gear case 50 are spray lubricated and do not run in oil. This also increases the life span of the gears by reducing friction and heat. The engine 10 of the present invention will function without the above improvements to the gears of the power gear case 50.

Figure 7:
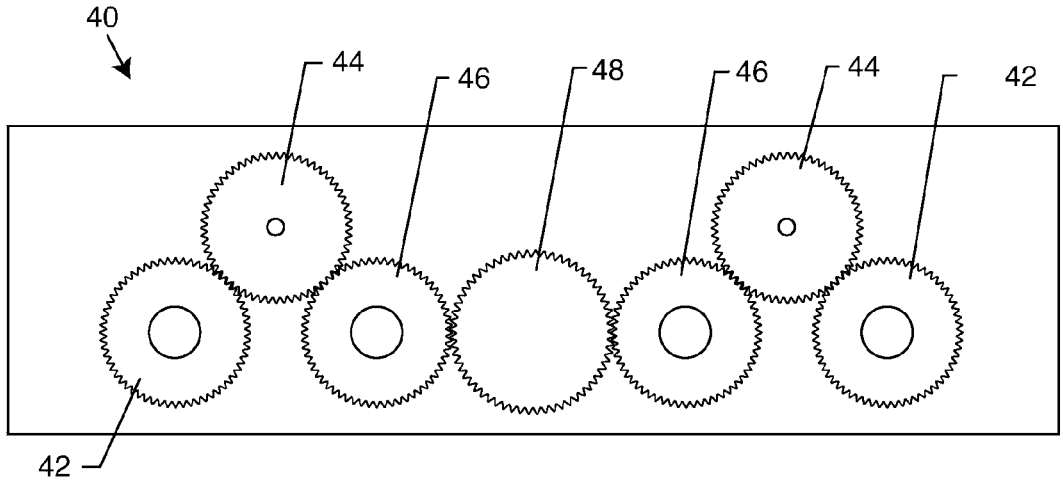
FIG. 7 is a sectional view of the accessory gears of the present invention taking along line 7-7 of FIG. 5.

The accessory gear case 40 may have gears similar to the gears in the power gear case 50. As shown in FIGS. 3, 4 and 7, the accessory gears may consist of a gear on the end of each crankshaft 42, a gear on the end of each eccentric shaft 44, idler gears 46, and a main accessory gear 48. The gears on the end of each eccentric shaft 44 may be offset as shown in FIGS. 3 and 7. Alternatively, as shown in FIG. 4, the gears in the accessory gear case 40 may consist of a gear on the end of each crankshaft 42, idler gears 46, and a main accessory gear 48. In either configuration, the idler gears would be hunting tooth gears. The gears of the accessory gear case 40 may include the same extra wide gear teeth and spray lubrication improvements discussed above for the power gear case 50.

Figure 5:
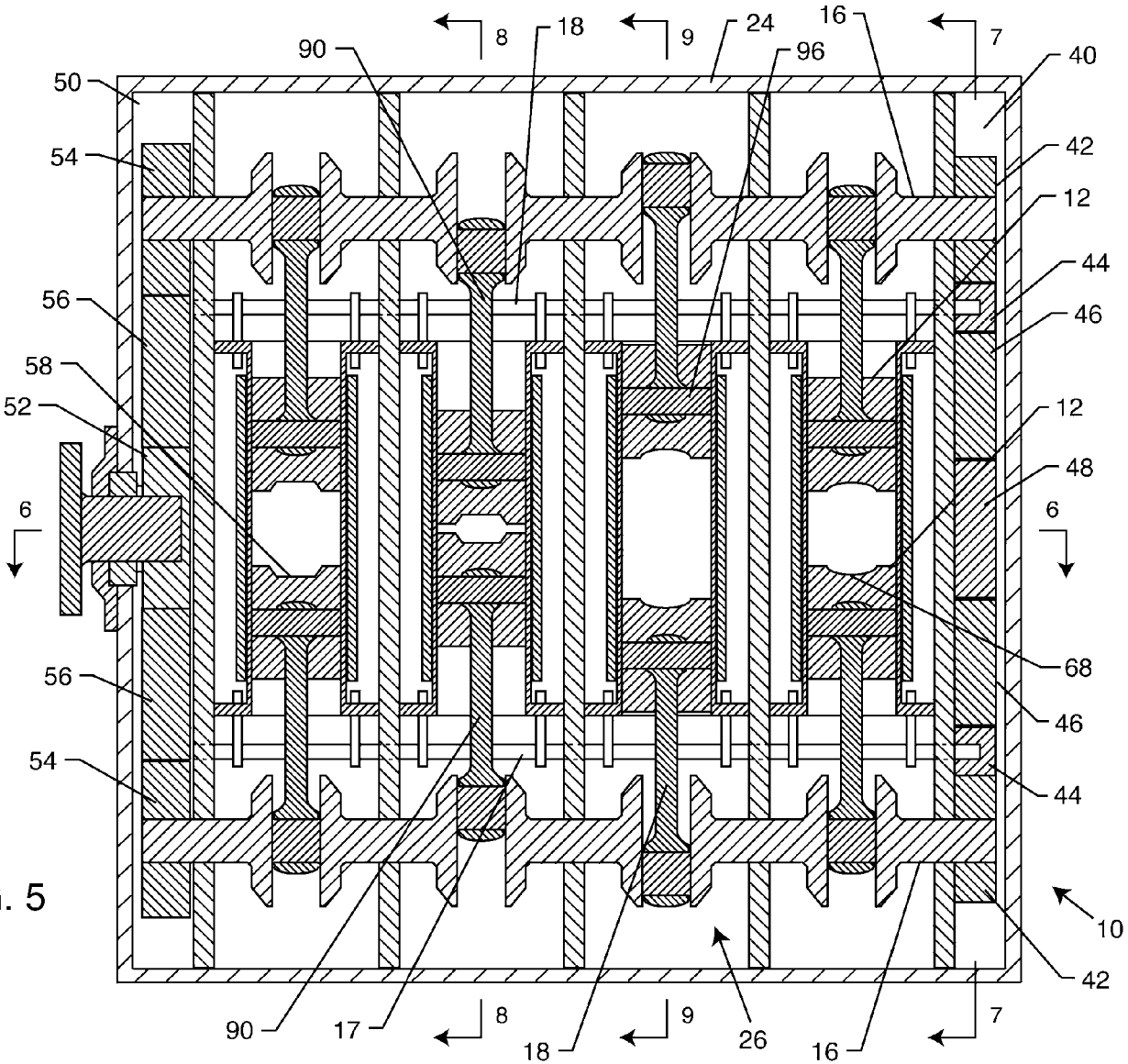
FIG. 5 is a sectional view of the engine of the present invention taking along line 5-5 of FIG. 1.
Figure 6:
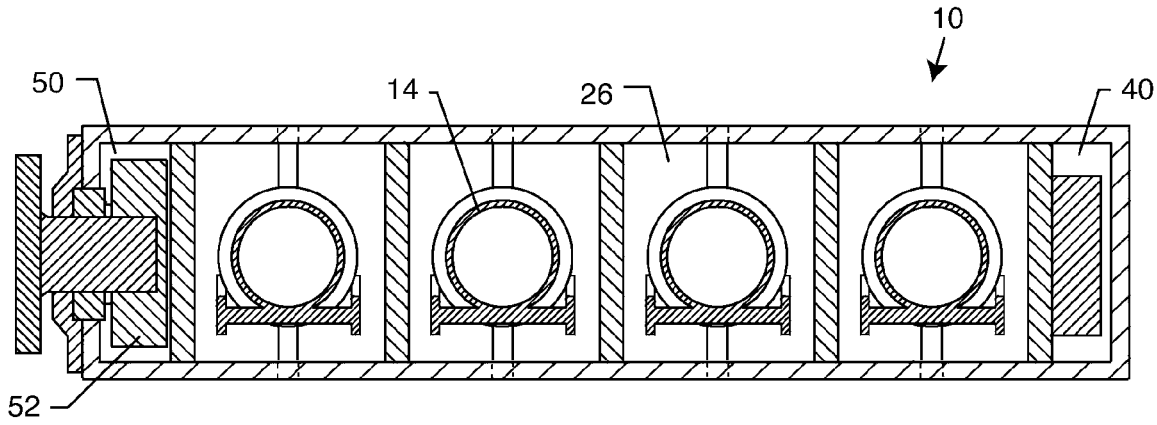
FIG. 6 is a sectional view of the engine of the present invention taking along line 6-6 of FIG. 5.

A shown in FIGS. 3-6, each cylinder 26 in the engine 10 contains two pistons 12, one on the intake side and one on the exhaust side. In FIG. 6, the ports, both intake 20 and exhaust 22, extend upwards and downwards from the piston cylinder 26. The cross-section shown in FIG. 6 is a mirror image of the cross-section that would be taken in the opposite direction of line 6-6 in FIG. 5.

All of the intake pistons 12*a* are driven by a first crankshaft 16*a* and all of the exhaust pistons 12*b* are driven by a second crankshaft 16*b*. As depicted in FIG. 5, each of the four intake pistons 12A and four exhaust pistons 12B are connected to their respective crankshafts 16A, 16B at positions offset from one another by 90 or 180 degrees. For example, the piston in the first cylinder and the piston in the fourth cylinder are offset from each other by 180 degrees. The piston in the second cylinder and the piston in the third cylinder are offset from one another by 180 degrees. The piston in the first cylinder is offset by 90 degrees from each of the pistons in the second and third cylinders. Similarly, the piston in the fourth cylinder is offset by 90 degrees from each of the pistons in the second and third cylinders. This results in a piston firing order of 1-3-4-2. Alternatively, the pistons may fire in the order of 1-2-4-3. The connection of the pistons to crankshaft and the firing order of pistons should be configured such that there is not more than a 90 degree difference between any sequential firing of the pistons and any sequential firing of pistons does not skip more than one cylinder.

For ease of reference, the middle of each cylinder where two pistons meet or the portion of any component toward the middle of each cylinder will be referred to as the top of the cylinder or component. Conversely, the portion of each cylinder or component adjacent each crankshaft will be referred to as the bottom of the cylinder or component.

As shown in FIGS. 3-4, around each piston 12 in each cylinder 26 is a piston sleeve 14. Each piston sleeve 14 is a circular cylinder that surrounds each piston 12. Each piston sleeve 14 has slotted openings 32 that align at least partially with either the intake ports 20 or exhaust ports 22 in each cylinder 26. The slotted openings 32 act to vary the porting characteristics of each cylinder 26 by altering when the intake 20 and exhaust ports 22 open and close as will be described below.

An eccentric shaft 18 runs parallel and adjacent to each crankshaft 16 and may be located above or below the crankshaft 16. In the preferred embodiment, the eccentric shaft 18 is located above the crankshaft 16, i.e., nearer the top of the cylinder 26. Each eccentric shaft 18 comprises portions of its length that include lobes which offset that portion of the shaft from its axis of rotation. Each piston sleeve 14 is connected to the eccentric shaft 18 nearest its bottom end. In the preferred embodiment, each piston sleeve 14 is connected to the eccentric shaft 18 by two sleeve connecting rods 34. However, the engine 10 will operate if only one sleeve connecting rod 34 is used. The use of two sleeve connecting rods 34 prevents undesirable twisting or torsion forces on the piston sleeve 14. In the preferred embodiment, the bottom of each piston sleeve 14 includes a lateral bearing shaft 36 affixed to a side of the piston sleeve 14 and parallel to the eccentric shaft 18. The lateral bearing shaft 36 provides a secure place to attach the sleeve connecting rods 34 to the piston sleeves 14. In addition, the bottom of each piston sleeve 14 has a strengthening band 38 around its perimeter to further stabilize the piston sleeve 14 against twisting and torsion forces. The lobes of the eccentric shaft 18 cause the piston sleeves 14 to reciprocate within the cylinder 26 in timed relationship with each piston 12 to vary the opening and closing of the intake 20 and exhaust ports 22 as will be described more fully below.

The eccentric shafts 18 are driven by means of a mechanical connection between each eccentric shaft 18 and the adjacent crankshaft 16. In one embodiment, adjacent crankshafts 16 and eccentric shafts 18 are geared together in a 1:1 ratio by using gears 42, 44 as shown in FIG. 3. In an alternate embodiment, adjacent crankshafts 16 and eccentric shafts 18 may include operating gears 60, 66 that are connected to a common gear 62 as shown in FIG. 4. These gears 60, 66 are also configured in a 1:1 ratio. The common gear 62 may be connected to an actuator 64 configured to advance or retard the timing of the eccentric shaft 18 with respect to the crankshaft 16.

Figure 14A:
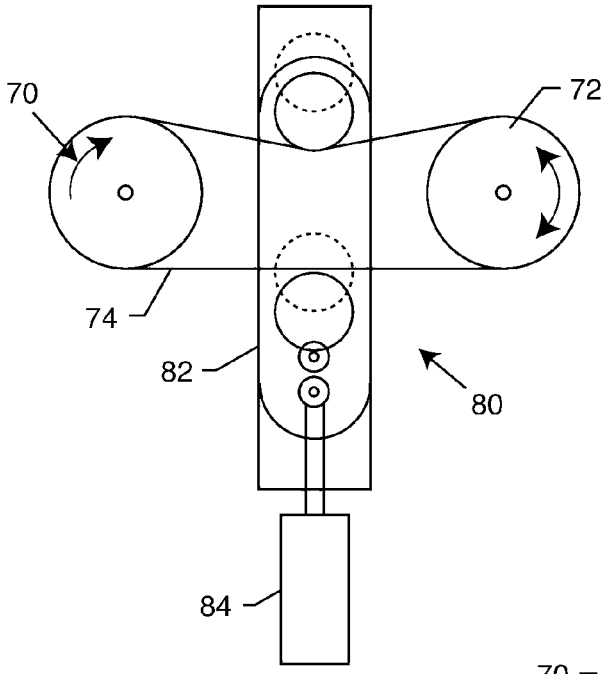
FIG. 14*a* is a schematic representation of the computer controlled timing guide and chain and sprocket assembly connecting the crankshaft to the eccentric shaft in the present invention.
Figure 14B:
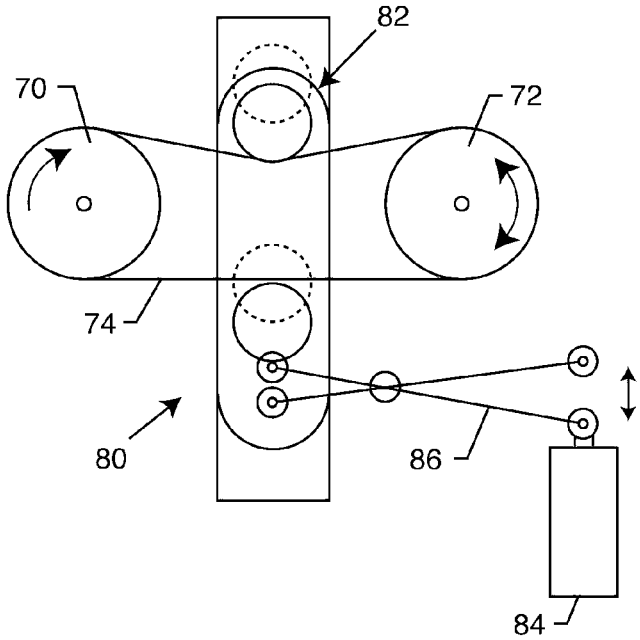
FIG. 14*b* is a schematic representation of an altered embodiment of the computer controlled timing guide and chain and sprocket assembly connecting the crankshaft to the eccentric in the present invention.

In the preferred embodiment, adjacent crankshafts 16 and eccentric shafts 18 include sprockets 70, 72 that are connected by a slack chain loop 74 as shown in FIGS. 14A and 14B. As with the gears 42 and 44 or 60 and 66, the sprockets 70, 72 are preferably in a 1:1 ratio. As shown in FIGS. 14A and 14B, a computer controlled guide 80 consisting of a slide 82 and actuator cylinder 84 may be connected to the chain loop 74. The actuator cylinder 84 may comprise a hydraulic or other mechanism and may be directly connected to slide 82 or may be connected to the slide by a lever 86. The position of the slide 82 with respect to the chain loop 74 may be varied by the actuator cylinder 84. In this way, the computer controlled guide 80 may advance or retard the timing of the eccentric shaft 18 with respect to the crankshaft 16. Advancing or retarding the timing of the eccentric shaft 18 with respect to the crankshaft 16 may be done to improve the efficiency or power of the engine 10 by altering the porting characteristics as will be described more fully below.

Figure 15:
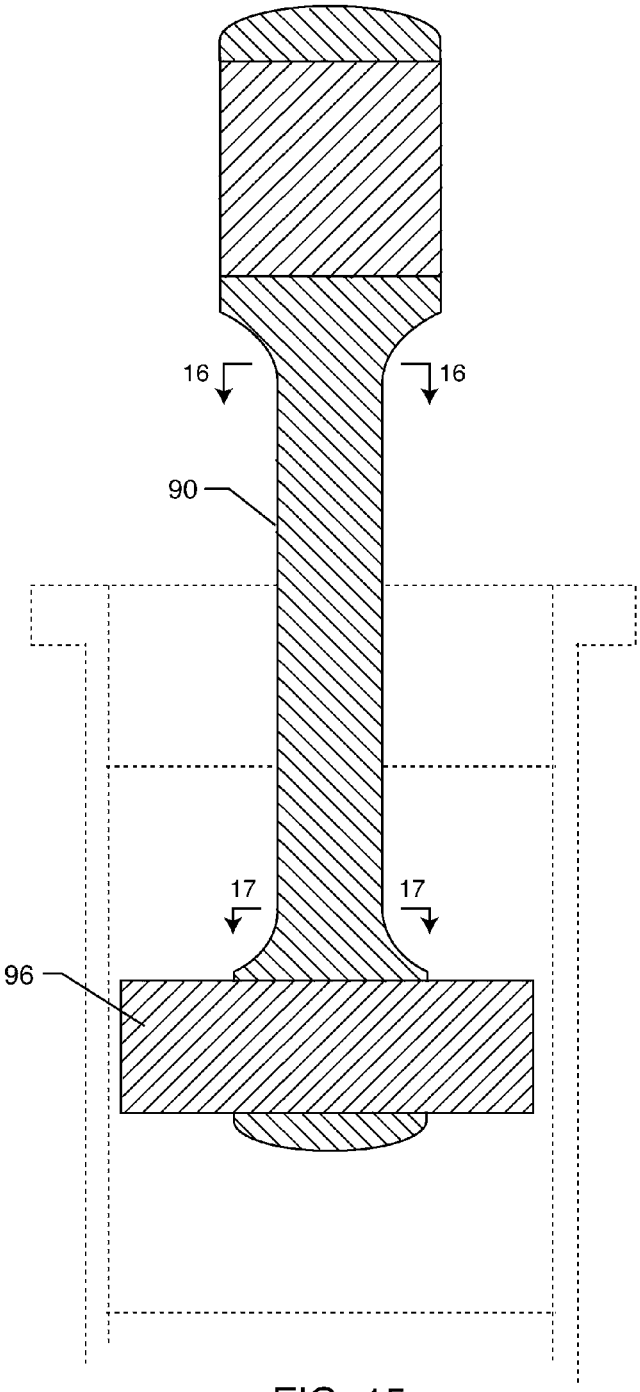
FIG. 15 is a cross-section of one of the piston connecting rods of the engine of the present invention.
Figure 16:
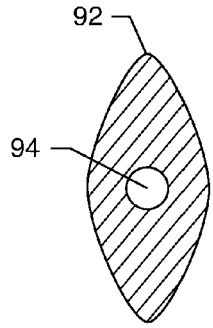
FIG. 16 is a cross-section of the piston connecting rod taking along lines 16-16 of FIG. 15.
Figure 16A:
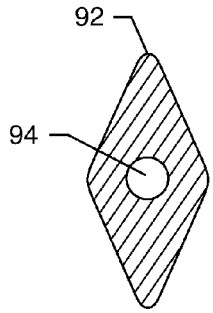
FIG. 16*a* is a cross-section of an alternate embodiment of a piston connecting rod of the present invention taking along line 16-16 of FIG. 15.
Figure 17:
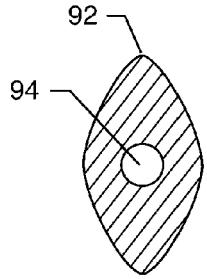
FIG. 17 is a cross-section of the piston connecting rod taking along line 17-17 of FIG. 15.
Figure 17A:
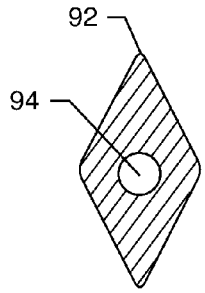
FIG. 17*a* is a cross-section of an alternate embodiment of a piston connecting rod of the present invention taking along line 17-17 of FIG. 15.

As shown in FIG. 15, the bottom of each piston 12 is connected to its adjacent crankshaft 16 by a piston connecting rod 90. In the preferred embodiment, as shown in FIGS. 16, 16A, 17 and 17A, the piston connecting rods 90 have a streamlined shape, either a pointed oval cross-section (FIGS. 16 and 17) or a flattened diamond cross-section (FIGS. 16A and 17A). The narrow points 92 of each piston connecting rod 90 are aligned with the top and bottom of the engine block 24 (NOTE: not the top and bottom of the cylinders). The streamlined piston connecting rods 90 reduce windage within the crank case or engine block 24. These types of cross-sections leave ample room for an oil pressure hole 94 through the connecting rod 90 to the piston wrist pin 96 and spray holes (not shown) for cooling the pistons 12. Such configuration is not possible with prior art connecting rods either H-beam or I-beam, in use in some current engine designs. This streamlined design for piston connecting rods 90 may be used in other types of engines, separate and apart from this engine 10.

In operation this two-cycle engine 10 develops a higher break mean effective pressure than comparable four-cycle engines. To accomplish this, the engine has blow through cylinders 26 with no spring operated parts. The pistons 12 themselves act as valves by opening and closing the intake 20 and exhaust ports 22. Blow through means that the exhaust ports 22 open just prior to the intake ports 20 in a given cycle. As air flows in the intake ports 20, it forces residual gasses out the exhaust ports. This purges the cylinder 26 from end to end. As the cycle continues the exhaust ports 22 close while the intake ports 20 remain open. Since the intake ports 20 remain open, they permit the inflow of additional air to increase the internal pressure in the cylinder 26, i.e., super charging the engine. The intake ports 20 then close and the cycle returns to the beginning. The following describes a preferred embodiment of how the engine operates. A person having ordinary skill in the art will recognize that variances in the positions of the pistons 12 and the piston sleeves 14 and when the intake ports 20 and exhaust ports 22 open and close will still achieve the objects of this invention.

Figure 8:
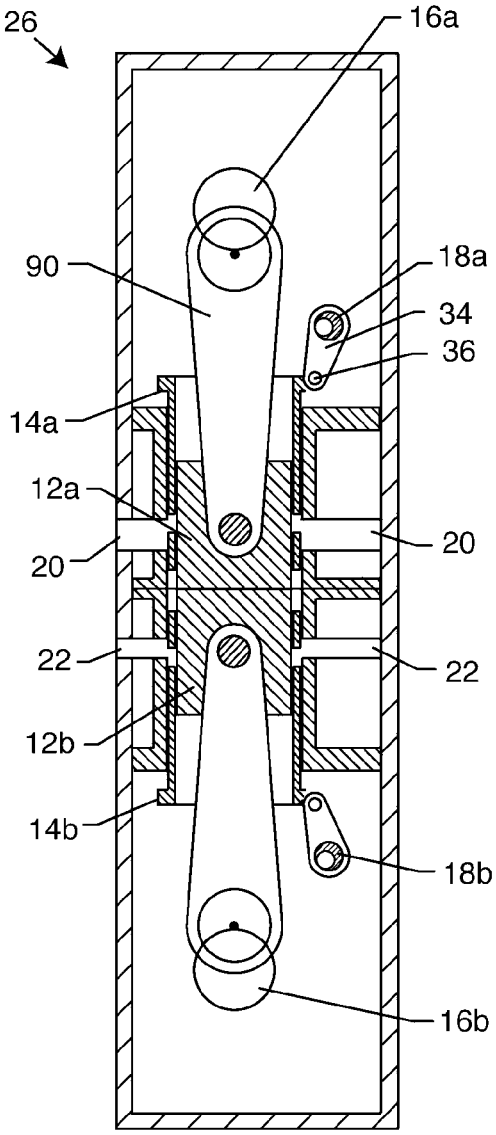
FIG. 8 is a sectional view of a cylinder of the present invention taking along line 8-8 of FIG. 5.
Figure 9:
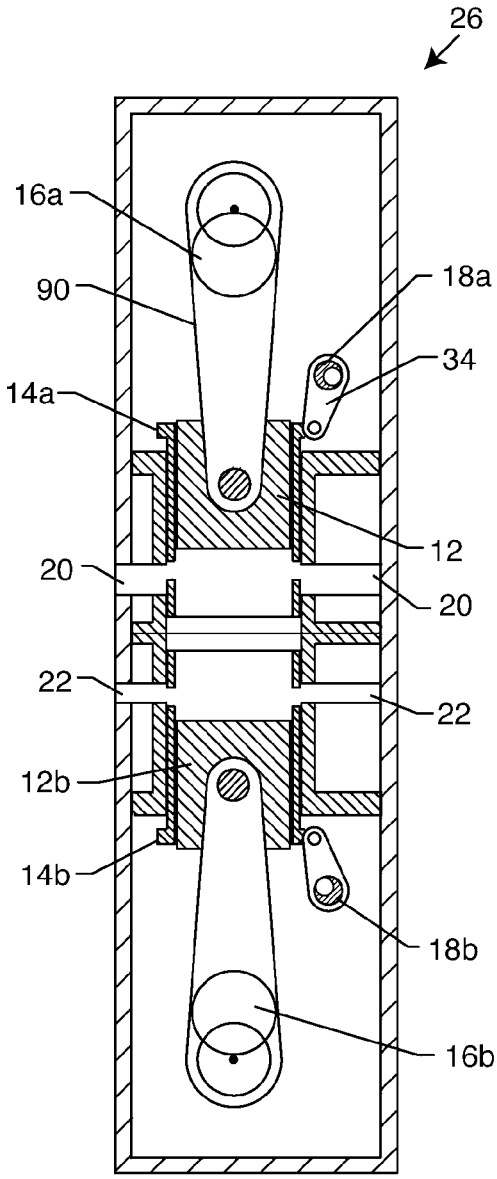
FIG. 9 is a sectional view of a cylinder of the present invention taking along line 9-9 of FIG. 5.
Figures 10, 11, 12, 13:
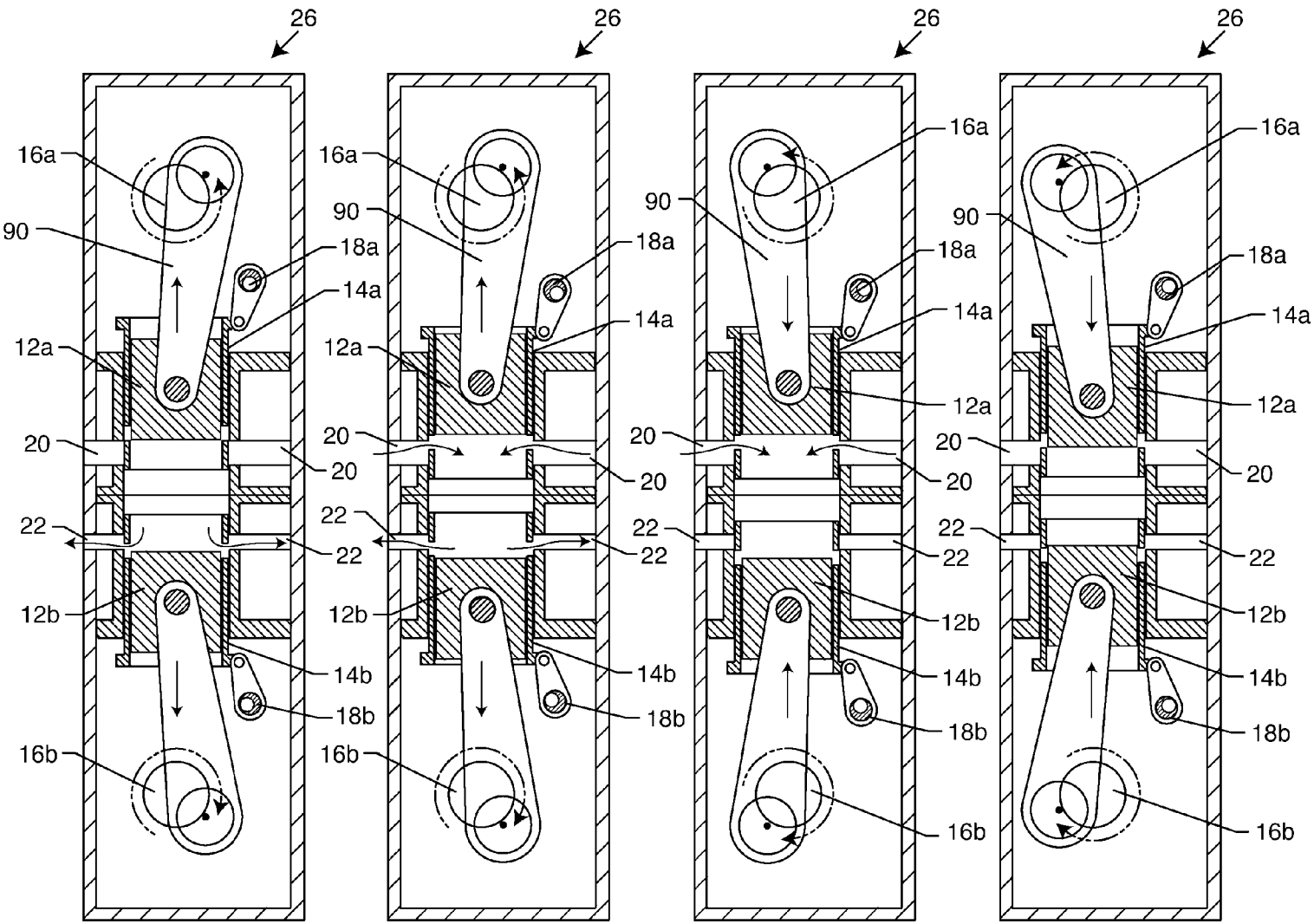
FIG. 10 is a depiction of a cylinder of the engine of the present invention shown at 60 degrees before bottom dead center.
FIG. 11 is a depiction of a cylinder of the engine of the present invention shown at 40 degrees before bottom dead center.
FIG. 12 is a depiction of a cylinder of the engine of the present invention shown at 40 degrees after bottom dead center.
FIG. 13 is a depiction of a cylinder of the engine of the present invention shown at 70 degrees after bottom dead center.

FIG. 8 depicts the relative positions of the pistons 12 and piston sleeves 14, as well as the status of the intake ports 20 and exhaust ports 22 for one cylinder 26 when the pistons 12 in that cylinder 26 are at top dead center. FIG. 10 depicts the relative positions of the pistons 12 and piston sleeves 14, as well as the fact that that the exhaust port 22 opens when the pistons 12 in a cylinder 26 are at 60 degrees before bottom dead center. FIG. 11 depicts the relative position of the pistons 12 and piston sleeves 14 and the fact that both the intake ports 20 and exhaust ports 22 are open when the pistons 12 in a cylinder 26 are at 40 degrees before bottom dead center. FIG. 9 depicts the relative positions of the pistons 12 and piston sleeves 14, as well as the status of the intake ports 20 and the exhaust ports 22 when the pistons in a cylinder 26 are at bottom dead center. FIG. 12 depicts the relative positions of the pistons 12 and piston sleeves 14, as well as the fact that the intake port 20 remains open while the exhaust port 22 closes when the pistons 12 in a cylinder 26 are at 40 degrees after bottom dead center. FIG. 13 depicts the relative positions of the pistons 12 and piston sleeves 14, as well as the fact that both the intake ports 20 and exhaust ports 22 are closed when the pistons 12 in a cylinder 26 are at 70 degrees after bottom dead center. The crankshafts 16 and eccentric shafts 18 continue their rotation around until the pistons 12 in a cylinder 26 reach top dead center again and then begin the cycle all over.

The reciprocating, ported piston sleeves 14 adjust when the intake ports 20 and the exhaust ports 22 open and close and the computer control guide 80 can advance or retard the timing of the eccentric shaft 18 with respect to the crankshaft 16. Advancing or retarding the timing can change the relative positions of the piston sleeves 14 with respect to the pistons 12 and adjust the opening or closing of the intake ports 20 and the exhaust ports 22. This can cause the intake ports 20 to open sooner or later than 40 degrees before bottom dead center and close sooner or later than 70 degrees after bottom dead center to maximize power and efficiency. Similarly, it can cause the exhaust ports 22 to open sooner or later than 60 degrees before bottom dead center and close sooner or later than 40 degrees after bottom dead center for the same reasons.

The top of the pistons 12 may have a concave cross section depending upon the type of fuel that is combusted in the engine 10. For diesel fuel, the top of the piston 12 would have an angled or stepped concave cross-section 58, as depicted in FIG. 5. If the fuel is gasoline, the top of the piston 12 would have a semi-circular concave cross-section 68, also as depicted in FIG. 5.

The engine 10 is designed to be built using flat plate construction. This means that the entire engine 10 is made of flat plate elements that are bolted, screwed and/or welded together in the three major elements: (1) crankcase or block 24; (2) cylinder port areas 26, 20, 22, and (3) firing chambers 28, 30 at the middle of the cylinders 26. The firing chambers are where the spark plug 30 and fuel injectors 28 are located on both the top and bottom sides of the engine block 24. All parts of the engine 10 may be constructed in a machine shop using a lathe, a mill, a drill press and a power saw. The engine 10 structure can be constructed from flat plate aluminum or similar materials, as well as, steel and/or stainless steel. Aluminum or other similar materials may also be used for the cylinders 26 and the piston sleeves 14. Materials that have been subjected to deep anodizing and treatment will also work in this engine 10. Quite a number of new materials are also being introduced in the industry, i.e., carbon composites, carbon fiber and ceramic materials, for high-temperature, high-strength applications that would be useful in the present engine 10.

The resulting engine 10 is an elongated box with no structural curves resulting in all straight-line stresses. The straight-line box structure of the engine block 24 renders very rugged diesel engines that are lighter than existing aircraft engines. The engine 10 design has no size limitations and may be made large enough to power ocean liners or small enough for outboard motors or motorcycles. As an engine 10, this design excels for vibration free, smooth running and power beyond comparable existing designs.

The interaction between the piston 12 and piston sleeves 14 with respect to the intake 20 and exhaust ports 22 provides for 360 degrees of auto growth porting allowing the highest air-flow ability of any engine 10. Auto growth porting means that the sizes of the intake 20 and exhaust ports 22 are effectively increased or decreased depending upon the interaction of the piston 12 and the piston sleeve 14 with the ports 20, 22. As the pistons 12 uncover the ports 20, 22, the piston sleeves 14 are moving opposite the pistons 12, thereby modifying the flow of incoming air and the outflow of exhaust gasses. As an added bonus, when the pistons 12 stop at the end of each stroke, the piston sleeve 14 is still moving. This keeps the pistons 12 on a constant film of oil resulting in nearly zero wear and very low friction.

Although several embodiments of the invention have been described in detail for purposes of illustration, various modifications of each may be made without departing from the spirit and scope of the invention. Accordingly, the invention is not limited except by the dependent claims.

What is claimed is:

1. An internal combustion engine having reciprocating piston sleeves, comprising:

an engine block having a pair of cylinders, each cylinder having an intake port, an exhaust port and two linearly opposing pistons connected to two opposing crankshafts; and a pair of piston sleeves reciprocatingly mounted in each cylinder around each piston and connected to two opposing eccentric shafts, each piston sleeve having slotted ports in communication with either the intake port or the exhaust port, wherein the eccentric shafts are mechanically connected to the crankshafts, wherein the eccentric shafts are geared to the crank shafts in a 1:1 ratio.

2. An internal combustion engine having reciprocating piston sleeves, comprising:

an engine block having a pair of cylinders, each cylinder having an intake port, an exhaust port and two linearly opposing pistons connected to two opposing crankshafts; and a pair of piston sleeves reciprocatingly mounted in each cylinder around each piston and connected to two opposing eccentric shafts, each piston sleeve having slotted ports in communication with either the intake port or the exhaust port, wherein the eccentric shafts are mechanically connected to the crankshafts, wherein the pistons are connected to the crankshafts by piston connecting rods having a pointed oval or a flattened diamond cross-section.

3. An internal combustion engine having reciprocating piston sleeves, comprising:

an engine block having a pair of cylinders, each cylinder having an intake port, an exhaust port and two linearly opposing pistons connected to two opposing crankshafts; and a pair of piston sleeves reciprocatingly mounted in each cylinder around each piston and connected to two opposing eccentric shafts, each piston sleeve having slotted ports in communication with either the intake port or the exhaust port, wherein the eccentric shafts are mechanically connected to the crankshafts, wherein each piston sleeve is connected to the eccentric shaft by two sleeve connecting rods.

4. The engine of claim 3, wherein each piston sleeve has a lateral bearing shaft on a bottom end and the sleeve connecting rods are connected to the lateral bearing shaft.

5. An internal combustion engine having reciprocating piston sleeves, comprising:

an engine block having a pair of cylinders, each cylinder having an intake port, an exhaust port and two linearly opposing pistons connected to two opposing crankshafts; and a pair of piston sleeves reciprocatingly mounted in each cylinder around each piston and connected to two opposing eccentric shafts, each piston sleeve having slotted ports in communication with either the intake port or the exhaust port, wherein the eccentric shafts are mechanically connected to the crankshafts, wherein each piston sleeve has a reinforcing band around a bottom end.

6. An internal combustion engine having reciprocating piston sleeves, comprising:

an engine block having a pair of cylinders, each cylinder having an intake port, an exhaust port and two linearly opposing pistons connected to two opposing crankshafts; and a pair of piston sleeves reciprocatingly mounted in each cylinder around each piston and connected to two opposing eccentric shafts, each piston sleeve having slotted ports in communication with either the intake port or the exhaust port, wherein the eccentric shafts are mechanically connected to the crankshafts, wherein the eccentric shafts are connected to the crankshafts by a chain and sprocket assembly in a 1:1 ratio, and further comprising a computer controlled guide on the chain.

7. The engine of claim 6, wherein the computer controlled guide comprises a slide on the chain and an actuator cylinder connected to the slide.

8. The engine of claim 7, wherein the actuator is connected to the slide by a lever means.

9. An internal combustion engine having reciprocating piston sleeves, comprising:

an engine block having a pair of cylinders, each cylinder having an intake port, an exhaust port and two linearly opposing pistons connected to two opposing crankshafts;

a pair of piston sleeves reciprocatingly mounted in each cylinder around each piston and connected to two opposing eccentric shafts, each piston sleeve having slotted ports in communication with either the intake port or the exhaust port, wherein the eccentric shafts are mechanically connected to the crankshafts; and an output gear connected to one or more idler gears connected to crankshaft gears, and one or more accessory gears connected to crankshaft gears.

10. The engine of claim 9, wherein the idler gears and accessory gears are hunting tooth gears.

11. The engine of claim 9, wherein the drive gear, idler gears, crankshaft gears and accessory gears are spray lubricated.

12. An internal combustion engine having reciprocating piston sleeves, comprising:

an engine block having a pair of cylinders, each cylinder having an intake port, an exhaust port and two linearly opposing pistons connected to two opposing crankshafts; and a pair of piston sleeves reciprocatingly mounted in each cylinder around each piston and connected to two opposing eccentric shafts, each piston sleeve connected to one of the eccentric shafts by two sleeve connecting rods, each piston sleeve having slotted ports in communication with either the intake port or the exhaust port, wherein the eccentric shafts are connected to the crankshafts by a chain and sprocket assembly in a 1:1 ration, and further comprising a computer controlled guide comprising a slide on the chain and an actuator cylinder connected to the slide.

13. The engine of claim 12, wherein the actuator is connected to the slide by a lever means.

14. The engine of claim 12, wherein the pistons are connected to the crankshafts by piston connecting rods having a pointed oval or a flattened diamond cross-section.

15. The engine of claim 12, wherein each piston sleeve has a reinforcing band around a bottom end.

16. The engine of claim 12, wherein each piston sleeve has a lateral bearing shaft on a bottom end and the sleeve connecting rods are connected to the lateral bearing shaft.

17. The engine of claim 12, wherein each piston has a semi-circular concave shape.

18. The engine of claim 12, wherein each piston has a stepped concave shape.

19. The engine of claim 12, including an output gear connected to one or more idler gears connected to crankshaft gears, and one or more accessory gears connected to crankshaft gears.

20. The engine of claim 19, wherein the idler gears and accessory gears are hunting tooth gears.

21. The engine of claim 19, wherein the drive gear, idler gears, crankshaft gears and accessory gears are spray lubricated.

* * * * *